US005445476A

United States Patent [19]

Sgouros et al.

[11] Patent Number: 5,445,476

[45] Date of Patent: Aug. 29, 1995

[54] REUSABLE OFFSHORE PLATFORM JACKET

[75] Inventors: George E. Sgouros, New Orleans; Dale M. Gallaher, Metairie, both of La.

[73] Assignee: Shell Oil Company, Houston, Tex.

[21] Appl. No.: 129,829

[22] Filed: Sep. 30, 1993

[51] Int. Cl.[6] ..... E02D 29/09; E02B 17/00

[52] U.S. Cl. ..... 405/224; 405/203; 405/227; 285/382.4; 285/382.5

[58] Field of Search ..... 405/195.1, 196, 203, 405/204, 222, 223, 224, 224.2, 225–228; 403/5, 31; 285/294, 297, 382.4, 382.5; 403/265, 268, 269; 29/507, 523

[56] References Cited

U.S. PATENT DOCUMENTS

| | | | |
|---|---|---|---|
| 3,380,520 | 4/1968 | Pease . | |
| 3,428,338 | 2/1969 | Corwin | 285/382.4 X |
| 3,535,884 | 10/1970 | Chaney . | |
| 3,550,384 | 12/1970 | Bardgette et al. | 405/227 |
| 3,575,005 | 4/1971 | Sumner . | |
| 3,716,994 | 2/1973 | Pogonowski . | |
| 3,860,270 | 1/1975 | Arnold | 285/294 X |
| 3,885,298 | 5/1975 | Pogonowski | 285/382.4 X |
| 4,083,193 | 4/1978 | Evans . | |
| 4,126,011 | 11/1978 | Lamy et al. | 405/196 |
| 4,147,385 | 4/1979 | van der Velden | 285/382.4 |
| 4,184,790 | 1/1980 | Bassett | 405/225 |
| 4,222,683 | 9/1980 | Schaloske et al. | 405/204 |
| 4,412,759 | 11/1983 | Britton et al. | 405/225 |
| 4,413,926 | 11/1983 | Ninet | 405/204 |
| 4,422,805 | 12/1983 | Sweatman | 405/225 |
| 4,436,454 | 3/1984 | Ninet et al. | 405/204 |
| 4,456,404 | 6/1984 | Evans | 405/196 |
| 4,492,270 | 1/1985 | Horton | 166/358 |
| 4,501,514 | 2/1985 | Lowes | 405/227 |
| 4,583,881 | 4/1986 | Steele | 405/198 |
| 4,585,374 | 4/1986 | Regalbuto et al. | 405/227 |
| 4,607,982 | 8/1986 | Brasted et al. | 405/204 |
| 4,633,953 | 1/1987 | Leboeuf et al. | 166/358 |
| 4,698,896 | 10/1987 | Osterwald et al. | 29/523 |
| 4,723,875 | 2/1988 | Sutton | 405/204 |
| 4,740,107 | 4/1988 | Casbarian et al. | 405/211 |
| 4,761,097 | 8/1988 | Turner | 405/204 |
| 4,762,442 | 8/1988 | Thomas et al. | 405/196 |
| 4,768,275 | 9/1988 | Schmitz | 29/507 X |

(List continued on next page.)

FOREIGN PATENT DOCUMENTS 201412 12/1982 Japan .

OTHER PUBLICATIONS

"Latest Technology Stresses Smarter, Quicker Operation" (Kurt S. Abraham, International Editor and henry D. Terrell, News Editor, *World Oil*, Jul. 1990, pp. 39–53.

"The Hydra-Lok Pile Swaging Tool," Marine Contractor Services, Inc. (MCS) (Copyright 1992), 18501 Aldine Westfield Rd., Houston, Tex. 77073.

(List continued on next page.)

*Primary Examiner*—Randolph A. Reese
*Assistant Examiner*—John A. Ricci
*Attorney, Agent, or Firm*—Mark A. Smith

[57] ABSTRACT

The present invention is a reusable jacket base for an offshore platform having a plurality of jacket legs with an interconnecting framework. Pile sleeves are connected to the jacket legs which have a vertically extended, open-ended cylindrical member having a second stage sleeve which is connected to the jacket leg and a first stage sleeve projecting coaxially from the second stage sleeve. First and second stage locking profiles are presented inside the first and second stage sleeves, respectively. The first stage sleeve is thus accessible for cutting operations, severing both the first stage sleeve with the first pile-to-pile sleeve connection inside and the connected pile section within. This allows retrieval of the platform jacket, but preserves a second stage pile sleeve for re-deployment. Another aspect of the present invention is an improved pile sleeve adapted to facilitate reuse.

11 Claims, 6 Drawing Sheets

U.S. PATENT DOCUMENTS

| | | | |
|---|---|---|---|
| 4,805,945 | 2/1989 | Foucault et al. | 285/382.5 X |
| 4,848,967 | 7/1989 | Weyler | 405/204 |
| 4,854,778 | 8/1989 | Valenzuela | 405/204 |
| 4,875,270 | 10/1989 | Krips et al. | 285/382.4 X |
| 4,902,169 | 2/1990 | Sutton | 405/204 |
| 4,902,170 | 2/1990 | Knox et al. | 405/225 |
| 4,917,541 | 4/1990 | Carruba | 405/227 |
| 4,934,869 | 6/1990 | Brandon et al. | 405/199 |
| 5,028,171 | 7/1991 | Gray | 405/225 |
| 5,049,004 | 9/1991 | Niimura | 405/204 |
| 5,094,568 | 3/1992 | Carruba | 405/227 |
| 5,102,266 | 4/1992 | Carruba | 405/227 |
| 5,163,783 | 11/1992 | Fahrmeier et al. | 405/195.1 |
| 5,228,806 | 7/1993 | DeMedieros et al. | 405/227 X |
| 5,288,174 | 2/1994 | Kjersem et al. | 405/196 |

OTHER PUBLICATIONS

"Unique Drilling/Production Jackup Set for 1993 Delivery," *Offshore,* vol. 51, No. 2, Feb. 1991, p. 42.

"Offshore Technology Conference '91," *World Oil,* Apr. 1991, pp. 121–135.

"Jack-Up Monopile Platform Uses Gravity-Base Storage," *Ocean Industry,* Apr./May 1991, p. 106.

George I. Viegas, "New Jackup Designs Proposed for Deepwater Operations," *Offshore,* vol. 51, No. 6, Jun. 1991, pp. 52–53.

"New Technology Is Shaped by North Sea, Subsea Markets" (Kurt S. Abraham, International Editor, Mark E. Teel, Engineering Editor, T. R. Wright, Jr., Editor), *World Oil,* Jul. 1991, pp. 39–56.

"Multi-Purpose Jack-Up Stands on Single Leg," *Ocean Industry,* Aug. 1991, pp. 39–40.

"European Operators, Drillers Embark on Cost-cutting Prgorams" (Neil Potter, News Editor, London), *Offshore,* Aug. 1991, pp. 33–40.

"Jack-Up Platform Suits Marginal Field Needs," *Ocean Industry,* Apr./May 1992, pp. 118–120.

Jeremy Beckman, "North Sea," *Offshore/Oilman,* vol. 52, No. 10, Oct. 1992, p. 12.

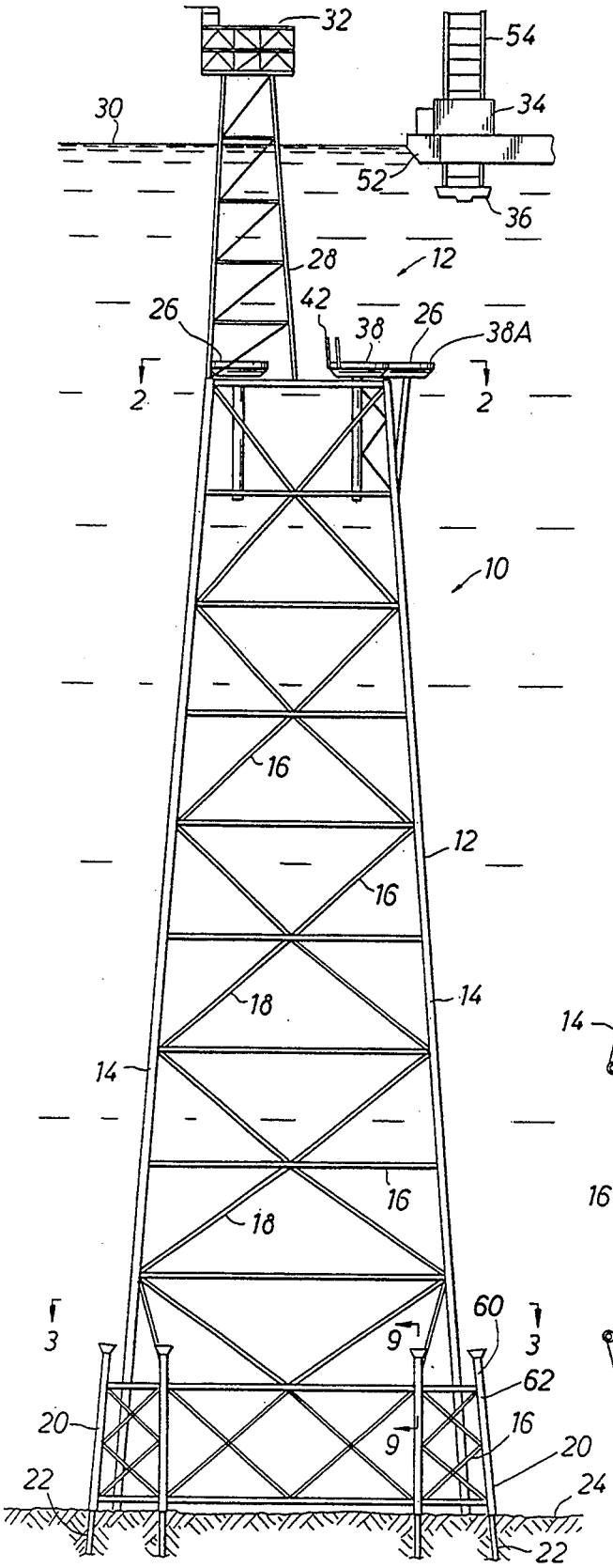
FIG. 1
FIG. 2
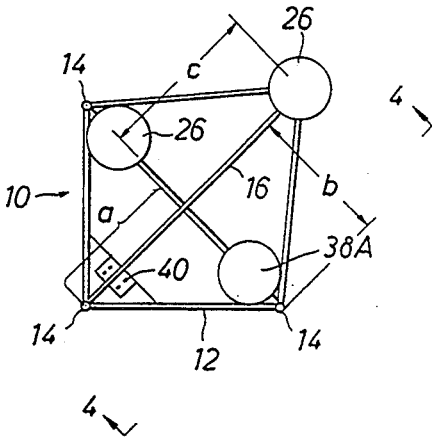
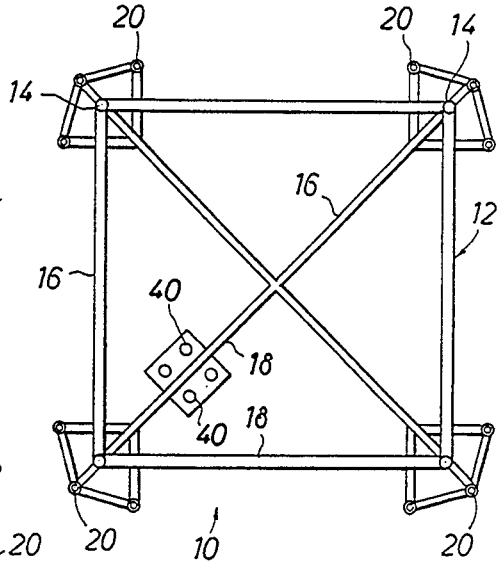
FIG. 3

FIG.5
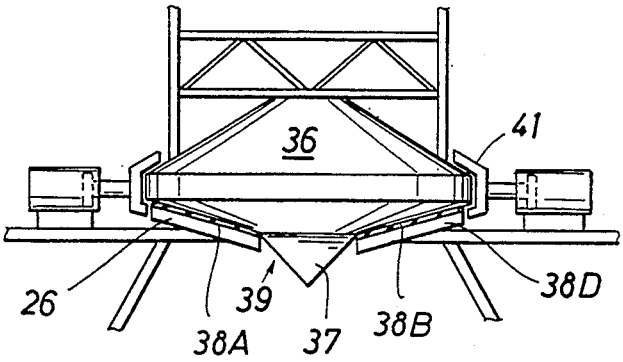
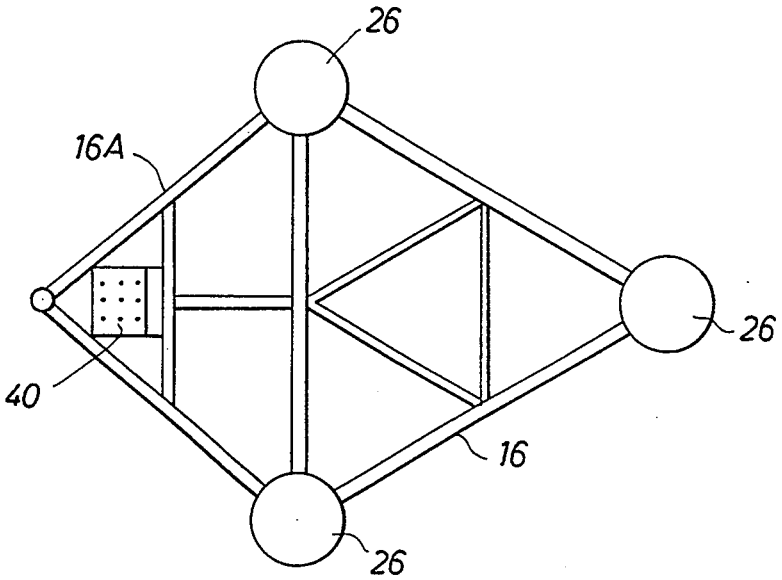
FIG. 7
FIG.8
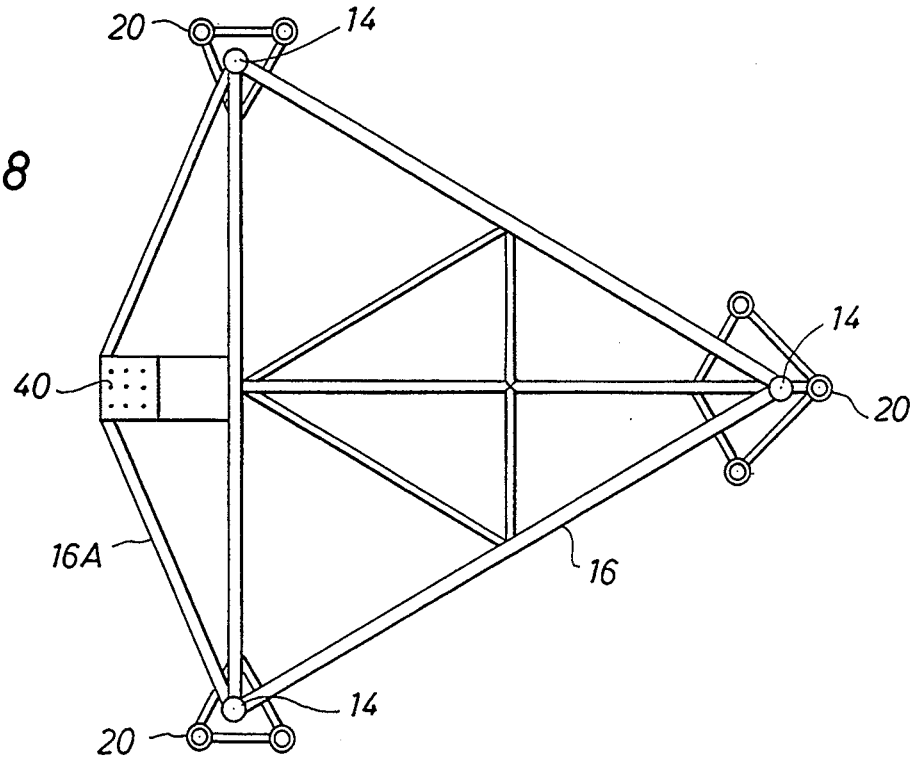

28
26
26
7
7
16A
16A
14
14
18
16
8
8
60
62
20
20
24
22
22

REUSABLE OFFSHORE PLATFORM JACKET

BACKGROUND OF THE INVENTION

The present invention relates to an offshore platform for conducting hydrocarbon recovery operations. More particularly, the present invention relates to a bottom-founded platform structure of the type pinned to the sea floor with piles.

The platform jacket is the structural tower of an offshore platform which supports one or more work decks above the ocean surface. This jacket consists of multiple legs interconnected by a framework of braces. Pile sleeves are connected to the legs at the base of the platform and piles are inserted through the pile sleeves and secured into the ocean floor during installation of the platform. Platform installation continues by securing the piles within the pile sleeves to complete a stable foundation for the platform.

However, the platform jacket often has a useful life exceeding the duration of profitable oil and gas production at the original site. It may then be desired to salvage the platform jacket for relocation. At this point, a secure pile-to-pile sleeve connection becomes a detriment, often requiring expensive underwater operations or transportation of the platform to onshore facilities to completely remove and then replace the pile sleeves.

There is thus a need for a means to facilitate platform jacket salvage and re-deployment that provides secure pile-to-pile sleeve connection, but also provides for easy separation from piles and reusable pile sleeves.

SUMMARY OF THE INVENTION

Toward the fulfillment of this need, the present invention is a reusable jacket base for an offshore platform having a plurality of jacket legs with an interconnecting framework. Pile sleeves are connected to the jacket legs which have a vertically extended, open-ended cylindrical member having a second stage sleeve which is connected to the jacket leg and a first stage sleeve projecting coaxially from the second stage sleeve. First and second stage locking profiles are presented inside the first and second stage sleeves, respectively. The first stage sleeve is thus accessible for cutting operations, severing both the first stage sleeve with the pile-to-pile sleeve connection inside and the top of the pile within. This allows retrieval of the platform jacket, but preserves a second stage pile sleeve for re-deployment.

Another aspect of the present invention is an improved pile sleeve adapted to receive piles in a hydraulically swaged locking relationship and having an extending cylindrical member and a first locking profile on the interior wall of the cylindrical member. The improvement comprises a second locking profile on the interior wall of the cylindrical member spaced apart from the first locking profile such that a first pile may be hydraulically extruded into first locking profile upon a first deployment of the offshore platform jacket. A portion of the pile sleeve and concentric pile is accessible at this first locking profile for removal to conveniently retrieve the offshore jacket for re-deployment to another location using the second locking profile.

BRIEF DESCRIPTION OF THE DRAWINGS

The brief description above, as well as further objects and advantages of the present invention, will be more fully appreciated by reference to the following detailed description of the preferred embodiments which should be read in conjunction with the accompanying drawings in which:

FIG. 1 is a side-elevational view of an offshore platform structure in accordance with one embodiment of the present invention.

FIG. 2 is a cross-sectional view of the offshore platform structure of FIG. 1 taken at line 2—2 in FIG. 1.

FIG. 3 is a cross-sectional view of the offshore platform structure of FIG. 1 taken at line 3—3 in FIG. 1.

FIG. 5 is an alternate embodiment of a subsea rig support interface applicable to a practice of the present invention.

FIG. 7 is a cross-sectional view of the offshore platform structure of FIG. 6 taken at line 7—7 in FIG. 6.

FIG. 8 is a cross-sectional view of the offshore platform structure of FIG. 6 taken at line 8—8 in FIG. 6.

DETAILED DESCRIPTION OF THE PREFERRED EMBODIMENTS

Figure 6:
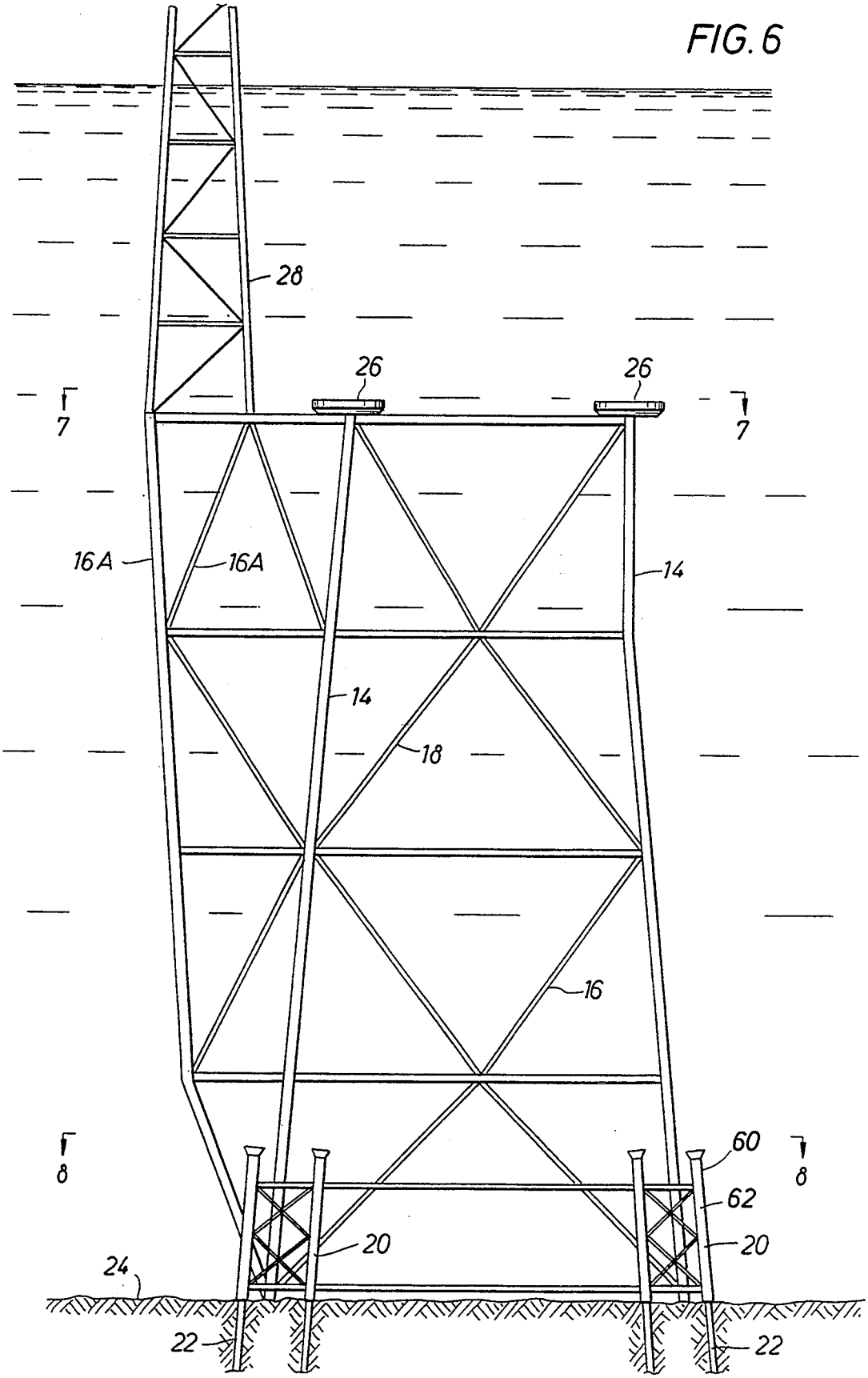
FIG. 6 is a side-elevational view of an offshore platform structure in accordance with an alternate embodiment of the present invention.

FIGS. 9–14 illustrate the use of a multiple stage pile-to-pile sleeve connection in accordance with the present invention. However, a review of FIGS. 1–8 sets forth an application of the present invention by disclosing preferred embodiments of an offshore platform structure and system which facilitate the reuse of platform jackets through multiple stage pile-to-pile sleeve connections. FIGS. 1–4 illustrate one application of the present invention with an offshore platform structure 10, and FIGS. 6–8 illustrate another embodiment of this application. In both instances, the structure has a jacket base 12 that is directly reusable across a range of water depths and the present invention facilitates salvage and re-deployment. Structure 10 (in FIG. 1) has a bottom-founded jacket base 12 having legs 14 with an interconnecting framework 16 of braces 18. Piles 22 are installed into ocean floor 24 through pile sleeves 20 by drilling and grouting or driving procedures known in the art. The piles are then secured within the pile sleeves by hydraulic locking or grouting operations.

The top of jacket base 12 is provided with a plurality of subsea rig support interfaces 26 and further supports surface tower 28 which extends above ocean surface 30 to support platform deck 32. Rig support interfaces 26 and surface tower 28 are arranged to accommodate reception of jack-up rig 34, here shown approaching offshore platform structure 10.

FIG. 2 is a cross section of offshore platform structure 10 illustrating a layout of subsea rig support interfaces 26 and surface tower 28 to accommodate a particular class of three leg jack-up rig (not shown). In this application, the rig support interfaces are positioned to receive feet 36 of jack-up rig 34 and efficiently transfer the load of offshore platform structure 10 to legs 14. The rig support interfaces should be below the wave zone, but well within the range of jack-up rigs, e.g., 200 feet or so below the ocean surface.

In one embodiment of this application, rig support interfaces 26 are provided by a load cushion 38A which is provided in FIGS. 1–4 by spud buckets 38 partially filled with a granular substance or other means to cushion the impact at touchdown and to disperse the load across the rig interface. The granular material must not only meet these load transfer characteristics, but also weather the environmental conditions and challenges such as scouring effects which tend to wash the granular material out of the open-top spud bucket even though it is positioned below the wave zone. Thus, sand, gravel or other granular material must be selected to accommodate these requirements. In one variation, cement or grout is placed in the spud bucket and sets after touchdown. Such a material may be selected to provide structural benefits to the system by resisting a moment applied across the jack-up rig to jacket base interface, yet to provide a limited adherence that is easily broken during de-mobilization of the jack-up rig for transfer to another site.

FIG. 5 illustrates another embodiment of subsea rig support interface 26 in which load cushion 38A is provided by a layer of cushioning material such as rubber or elastomeric cushion 38B over a steel lattice structure 38D. The lattice structure has a hole or receptacle 39 which receives a pin 37 on foot 36 for an advantage of more exact load placement and resistance to lateral loads. Further, if desired, hydraulically driven gripping arms 41 may be deployed to engage the edges of foot 36 to provide resistance to a moment applied across the jack-up rig to jacket base interface.

FIG. 2 also illustrates a plurality of conductors 40 arranged through surface tower 28. Drilling may be undertaken through each of the conductors using the jack-up rig which may also complete the well and sets production risers through conductors 40. Alternatively, platform deck 32 may accommodate surface completions with a workover rig installed thereon. The platform deck of the surface tower also facilitates production while drilling ("PWD") operations by supplying deck space for production facilities not easily accommodated on jack-up rigs designed for drilling alone.

Figure 4:
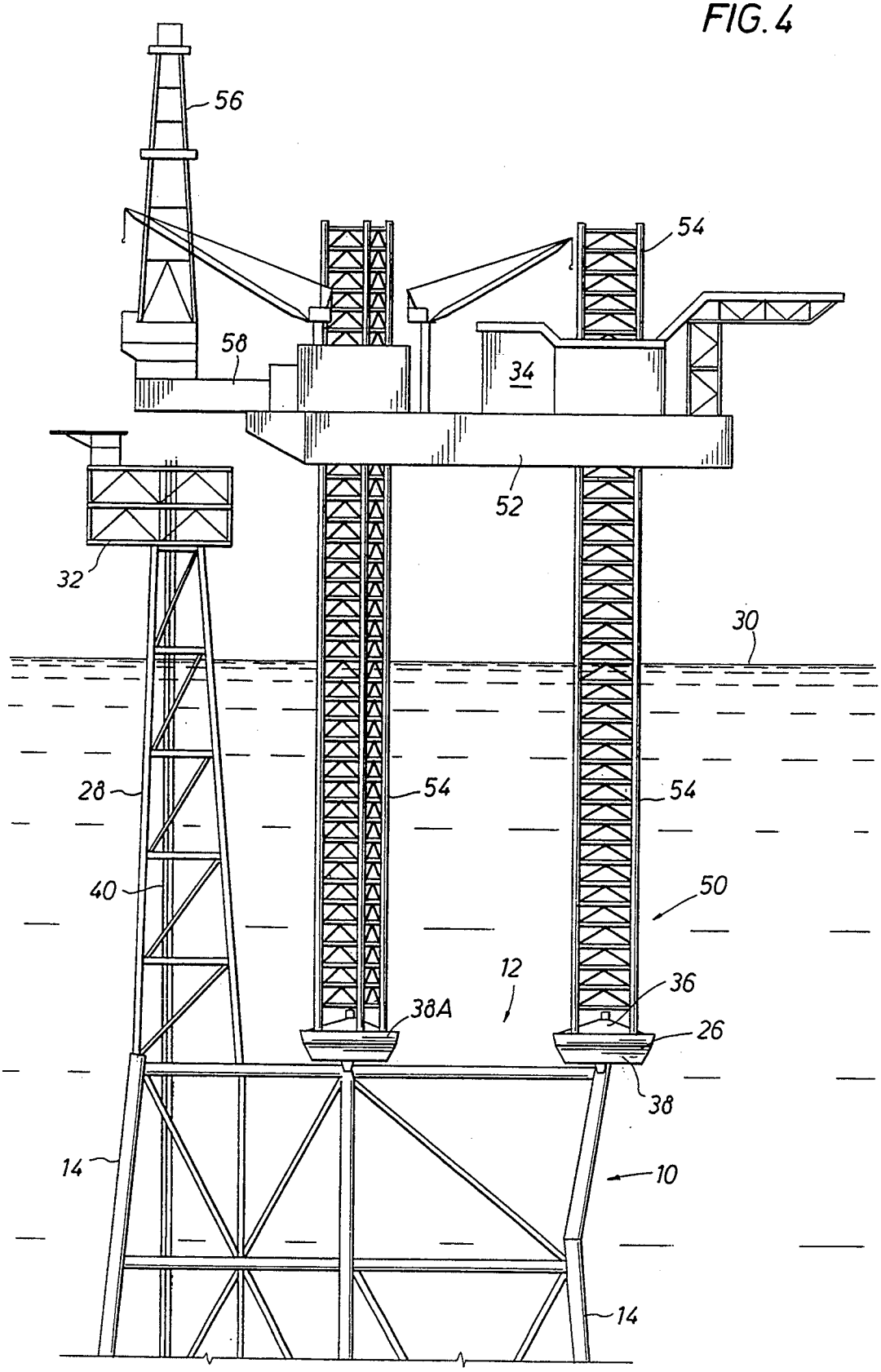
FIG. 4 is a side-elevational view of an offshore platform system in accordance with one embodiment of the present invention, as viewed from the vantage of line 4—4 in FIG. 2, but including a deployed jack-up rig.

FIG. 4 illustrates jack-up rig 34 in place on jacket base 12 of offshore platform structure 10. Together these comprise offshore platform system 50. In this embodiment, jack-up rig 34 has three retractable legs 54 depending from a hull/deck member 52. Drilling and other facilities are provided by the jack-up rig, including a derrick 56, which is conveniently provided on a cantilever deck 58.

Deployment of jack-up rig 34 (see FIG. 1) is facilitated by means for aligning the jack-up rig with subsea rig support interfaces 26. This means may, for example, be provided in a cooperation between the hull/deck 52 of the jack-up rig as it floats in an alignment through a bumper engagement with a vertical face of surface tower 28 prior to jacking operations. Alternatively, at least one installation guide 42 may project substantially vertically above the periphery of one or more of spud buckets 38 to engage feet 36 on descending legs 54 during jacking operations (see FIGS. 1 and 2). Further, these and other means for alignment may be combined.

After touchdown of feet 36 within rig support interfaces 26, further jacking operation transfers the load of the jack-up rig from buoyant hull/deck 52 to jacket base 12, ultimately raising the hull/deck from the water, above the splash zone, and in position to extend retractable cantilevered deck 58 so as to position derrick 56 over surface tower 28. Well operations may then be shifted among the conductors by skidding the derrick on the cantilever deck without moving hull/deck 52 of the jack-up rig.

A comparison of the cross sections of FIGS. 2 and 3 illustrates another aspect of this application. The cross section of FIG. 2 at the top of the jacket base is skewed to a diamond shape to provide support for the subsea rig support interfaces 26 in substantial alignment with legs 14 of the jacket base. However, this quadrilateral cross section does not extend outwardly the leg 14 which is associated with surface tower 28 at the first corner of the jacket base. Thus, the first corner is a shorter distance "a" from an intersection of lines diagonally bisecting the cross section at this level than distances "b" or "c" with respect to the other corners. This relationship contributes to providing a wide spread at subsea rig support interface 26 to accept the feet of jack-up rig 34, yet maintains surface tower 28 adjacent the jack-up rig for convenient access with a cantilevered deck.

By contrast, the cross section of FIG. 3 at the base of the offshore platform is a more conventional square or rectangular shape in this embodiment which facilitates traditional transport and deployment. FIG. 3 also illustrates the connection of pile sleeves 20 to legs 14.

FIGS. 6–8 illustrate another application well suited to the present invention in which jacket base 12 has three legs 14 arranged with braces 18 of framework 16 in a triangular cross section. Here surface tower 28 is supported by interconnecting framework 16A to the jacket base in a parallel, overlapping relation. This affords a minimal footprint to jacket base 12, thereby reducing material requirements. The structural requirements for surface tower 28 to support a facilities deck, workover rig, risers and riser conductors, is much less than that required to support a jack-up rig 34. Separating these support requirements may allow an overall reduction in steel despite the overlap of surface tower 28 to jacket base 12.

This application of the present invention addresses reducing costs not only by providing support only where it is needed but by designing a platform system 50 that matches structural capabilities to meet relevant design criteria on a seasonally adjusted basis. The ease of jack-up rig deployment and demobilization as a self-contained mobile unit facilitates employing a method of conducting platform operations that can further reduce platform costs.

Thus, offshore platform structure 10 is installed and jack-up rig 34 is mated thereon to establish an offshore platform system 50 for conducting well operations during non-hurricane seasons. However, the jack-up rig is demobilized and withdrawn from the offshore platform structure for hurricane season. This permits the combined offshore platform system 50 to be designed on the less extreme basis of winter storm criteria and greatly reduces the weight, wind and wave loads of the offshore platform structure 10 itself (absent the jack-up rig) which is still designed to meet hurricane criteria. This relation can even continue for embodiments of the offshore platform structure which include a workover rig on the platform deck.

Figure 9:
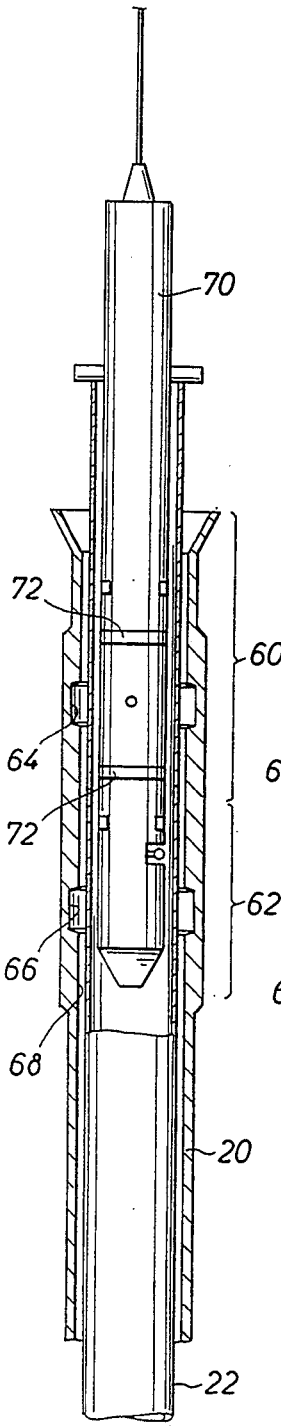
FIG. 9 is a cross-sectional view of a pile deployed through a multi-stage pile sleeve in accordance with the present invention taken from the vantage of line 9—9 in FIG. 1, but taken during installation.
Figure 10:
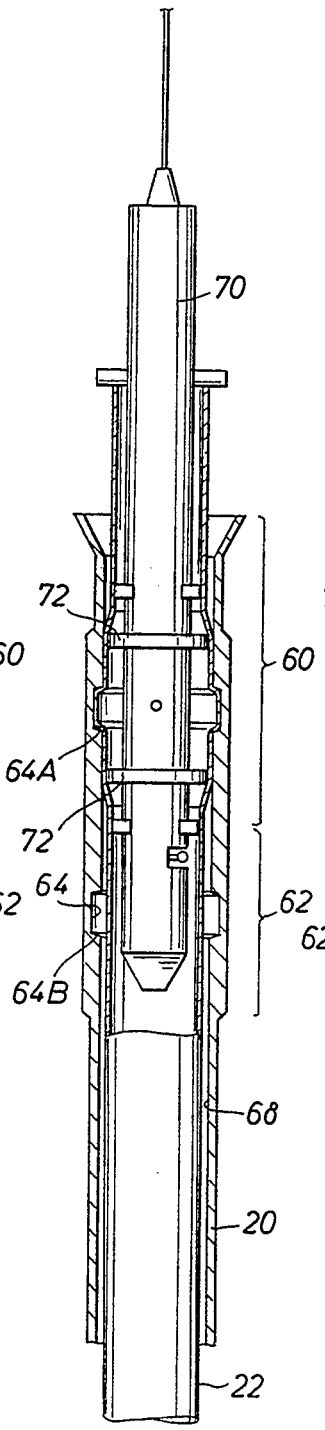
FIG. 10 is a cross-sectional view of a locking tool securing the pile of FIG. 9 within the uppermost stage of the pile sleeve.
Figure 11:
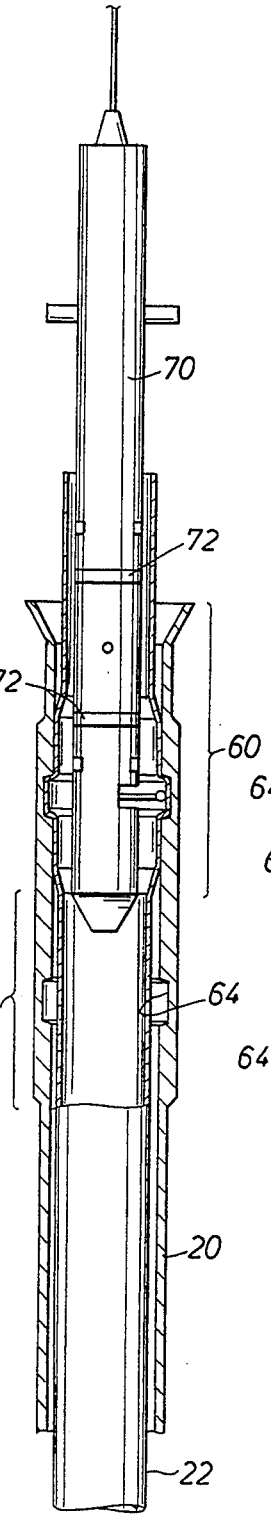
FIG. 11 is a cross-sectional view of the withdrawal of the locking tool of FIG. 10 following swaging operations.
Figure 12:
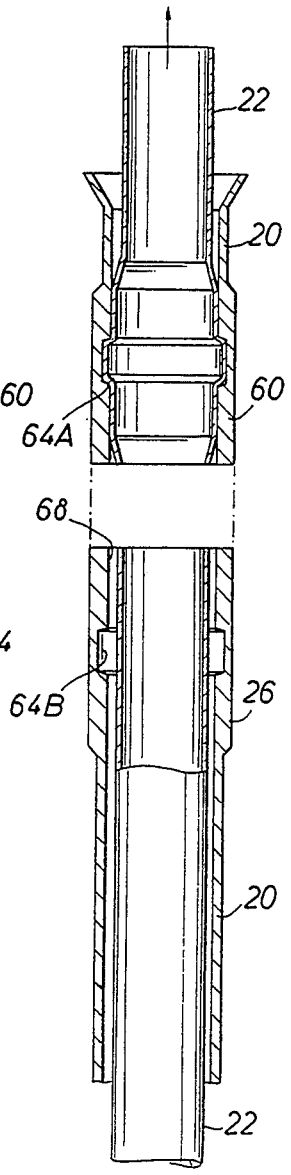
FIG. 12 is a cross-sectional view of a first stage of the pile sleeve severed from latter stages to facilitate salvage and reuse of the jacket base.

Returning to an embodiment of the present invention, FIG. 9 is a longitudinal cross section of pile 22 which has been secured to the ocean floor through pile sleeve 20. This cross section is taken from the vantage point of line 9—9 in FIG. 1, but illustrates an installation step in one embodiment of the present invention which facilitates reuse of offshore platform structure 10 after depletion of a reservoir.

In this embodiment, pile sleeve 20 is an open-ended cylindrical member having extended multiple stages, here illustrated by a first and second stage sleeves 60 and 62. First stage sleeve 60 projects coaxially from second stage sleeve 62 to facilitate access for salvage operations (see also FIG. 1). Both the first and second stage sleeves have locking profiles 64, here provided by an annular groove 66 on the interior surface of the cylindrical member 68.

Offshore platform structure 10 is launched and placed and piles 22 are secured into the seafloor through pile sleeves 20 by driving or by drill and grout operations. At that point a locking tool 70 is run inside the pile which is held concentrically within the pile sleeve (see FIG. 9). Seals or packers 72 are activated to secure a hydraulic seal above and below the first locking profile 64A and to isolate the second locking profile 64B.

Hydraulic pressure is introduced to the interior of pile 22 through locking tool 70 to the annular region bounded by the locking tool and the pile between seals 72. The pressure extrudes or swages the pile into locking profile 64A to form a secure connection (see FIG. 10). Thereafter, seals 72 are deactivated and locking tool 70 is removed from the pile and is used for succeeding pile-to-pile sleeve connections as installation operations continue. Alternatively, mechanical swaging operations may be isolated to the first locking profile causing the pile to conform to the shape of the first locking profile in a secure engagement.

Figure 13:
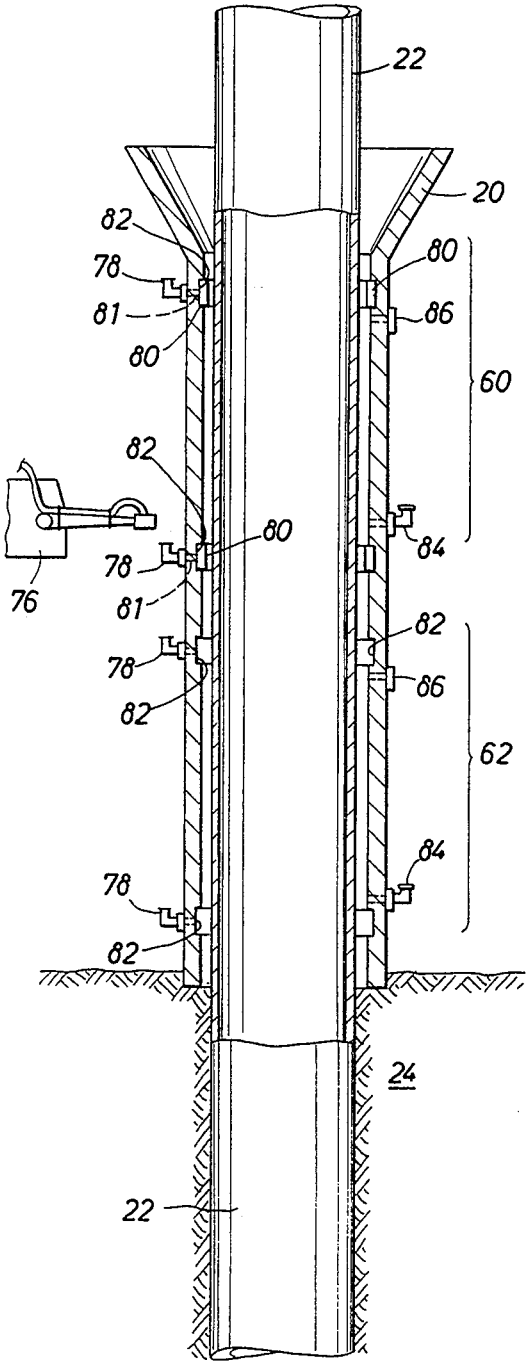
FIG. 13 is a cross-sectional view of an alternate embodiment of the present invention taken from the vantage of line 9—9 in FIG. 1, but taken during installation.
Figure 14:
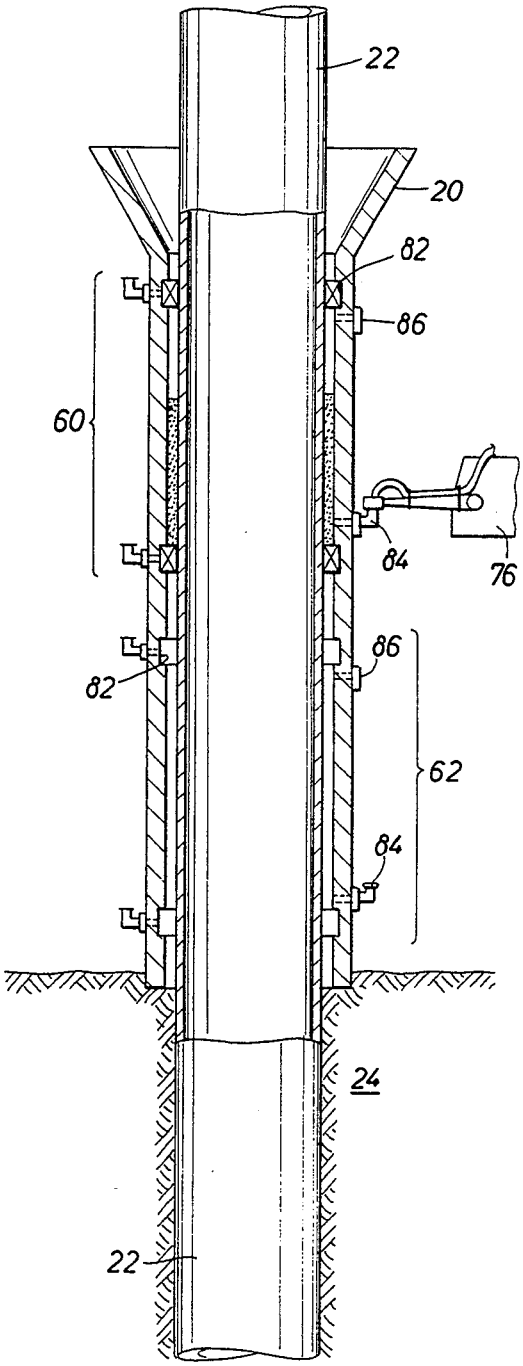
FIG. 14 is a cross-sectional view of an embodiment of the present invention during grout injection.

Another embodiment of the multiple stage pile-to-foundation connection of the present invention is illustrated in FIGS. 13 and 14 in which the pile-to-pile sleeve connection is secured by grout. In FIG. 13, remotely operated vehicle ("ROV") 76 is attaching to a nipple 78 presented on the exterior of the pile sleeve for hydraulicly inflating packer 80 through a fluid conduit 81. Upon actuation, packer 80 expands from recess 82 to seal across the pile-to-pile sleeve annulus and isolate first stage 60 from second stage 62. If it is desired to keep the grout from open contact with seawater, a second packer 80 is deployed on the upper bounds of the first stage and a grout return valve is provided immediately adjacent thereto. The length of the annular first stage locking profile is dependent upon the friction of the grouted zone necessary to manage the design loads.

In FIG. 14, packers 80 have deployed with hydraulic pressure supplied by ROV 76 and the ROV is in communication with a source of grout. The ROV attaches to grout placement valve 84 and injects grout, displacing the seawater and filling the annulus until grout reaches grout return valve 86. The ROV is removed and the grout sets in the first stage locking profile. Note, that packers 80, valves and nipples of second stage 62 may be omitted in the initial installation and conveniently installed in minimal offshore operations after salvage of the jacket.

Offshore platform structure 10 may have a useful life exceeding the life of profitable production from the hydrocarbon reserves at the initial site of deployment. It may then be desired to salvage the offshore platform structure 10 for relocation. At this point surface facilities are removed to prepare the jacket base for recovery.

Returning to FIGS. 9–12, placing the initial extruded locking engagement in an accessible location facilitates simple cutting operations, through both pile sleeves 20 and piles 22, around the base of the offshore platform structure. In the illustrated embodiment, first stage pile sleeve 62 is accessible as an extension projecting upwardly from the bracing which connects pile sleeve 20 to Jacket legs 14 (see FIG. 1). However, other configurations may be employed; e.g., a downwardly projecting extension in which the first stage is presented on the bottom. In this latter embodiment, explosive cutting from inside the pile may be preferable to traditional cutting means. The first stage extension and the pile section therein is separated from the cylindrical members (see FIG. 12). This permits the jacket base to be floated or lifted by crane, readied for transport and carried to a new site. Second locking profile 64B remains available for a re-deployment of the offshore platform structure. The embodiment of FIGS. 13 and 14 would be similarly salvaged and re-deployed. Further, these salvage operations may be aided by providing additional ballast chambers within the platform jacket into which air may be pumped for a reserve buoyancy that facilitates one-piece retrieval.

The multi-stage locking profile arrangement of the present invention facilitates successive deployments of an offshore platform structure. This presents particular advantages with a jacket base having flexibility for re-deployment throughout a range of water depths, e.g., in combination with a jack-up rig that may adjust to differences in water depths. However, the present invention will be seen by those having ordinary skill in the art as applicable to a full range of offshore foundations on other jacket structures which are pinned to the ocean floor with piles.

Other modifications, changes and substitutions are intended in the foregoing disclosure and in some instances some features of the invention will be employed without a corresponding use of other features. Accordingly, it is appropriate that the appended claims be construed broadly and in the manner consistent with the spirit and scope of the present invention.

What is claimed is:

1. A reusable jacket base for an offshore platform of a configuration suitable to secure to an ocean floor upon installation with a plurality of piles, the jacket base comprising:

a plurality of jacket legs;

framework interconnecting the jacket legs; and a plurality of pile sleeves connected to the jacket legs, the pile sleeves comprising:

a vertically extended, open-ended cylindrical member having a second stage sleeve which is connected to the jacket leg and a first stage sleeve projecting coaxially from the second stage sleeve;

a first stage locking profile inside the first stage sleeve; and a second stage locking profile inside the second stage sleeve.

2. A reusable jacket base in accordance with claim 1 wherein the first and second stage locking profiles are each at least one annular groove in the interior wall of the cylindrical member whereby the first and second stage locking profiles are configured to receive an extrusion from one of the piles inserted therethrough at installation to form a secure connection.

3. A reusable jacket section in accordance with claim 1 wherein the first and second stage locking profiles are annular surfaces capable of sustaining a secure, grouted pile sleeve-to-pile sleeve connection, the jacket section further comprising:

an annular recess in the cylindrical member separating the first and second stage sleeves;

a packer installed in the annular recess disposed to selectively deploy a seal between the cylindrical member of the pile sleeves and the pile to isolate the first stage sleeve from the second stage sleeve during initial deployment of the jacket section;

an actuating fluid conduit in communication with the packer; and a grout placement valve providing access to the interior of the first stage pile sleeve.

4. In an improved pile sleeve adapted to receive a pile in a securely connected relationship and having an extending cylindrical member and a first locking profile on the interior wall of the cylindrical member, the improvement comprising:

a second locking profile on the interior wall of the cylindrical member spaced apart from the first locking profile such that the pile may be hydraulically extruded into the first locking profile upon a first deployment of the offshore platform jacket, a portion of the pile sleeve and concentric pile at this first locking profile being accessible for removal to conveniently retrieve the offshore jacket for redeployment to another location using the second locking profile.

5. An improved pile sleeve in accordance with claim 4 wherein said first and second locking profiles are each at least one annular groove in the interior wall of the cylindrical member whereby the first and second stage locking profiles are configured to receive an extrusion from one of the piles inserted therethrough at installation to form a secure connection.

6. An improved pile sleeve in accordance with claim 4 wherein the first and second stage locking profiles are annular surfaces capable of sustaining a secure, grouted pile sleeve-to-pile sleeve connection, the improved pile sleeve further comprising:

an annular recess in the cylindrical member separating the first and second stage sleeves;

a packer installed in the annular recess disposed to selectively and sealingly deploy between the cylindrical member of the pile sleeves and the pile to isolate the first stage sleeve from the second stage sleeve during initial deployment of the jacket section;

an actuating fluid conduit in communication with the packer; and a grout placement valve providing access to the interior of the first stage pile sleeve.

7. A method for connecting a pile to a pile sleeve in the foundation of an offshore platform jacket, comprising:

setting the pile into an ocean floor through the pile sleeve;

isolating a first stage of a pile-to-pile sleeve interconnection which is presented in an extension of the pile sleeve from a second stage of the pile sleeve suitable to secure a pile-to-pile sleeve interconnection; and securing the pile to the pile sleeve at the first stage during a first deployment of the offshore platform jacket;

whereby the second stage is reserved and conveniently available for a pile-to-pile sleeve interconnection should the offshore platform jacket be salvaged and redeployed;

retrieving the offshore platform jacket upon depletion of hydrocarbon reserves at the initial site, comprising;

cutting the concentric pile and pile sleeve anal removing the extension of the pile sleeve containing the first stage of pile-to-pile sleeve interconnection; and raising the offshore platform jacket and rigging for transport; and redeploying the offshore platform jacket.

8. A method in accordance with claim 7 wherein isolating the first stage from the second stage comprises:

inserting a locking tool into the pile; and securing hydraulic seals in the pile above and below the level of a first locking profile in the first stage of the pile sleeve, but at a level not aligned with a second stage locking profile; and wherein securing the pile to the pile sleeve comprises extruding the walls of the pile into the first locking profile with hydraulic pressure provided by the locking tool.

9. A method in accordance with claim 7 wherein isolating the first stage from the second stage comprises:

setting a packer in the annulus between pile and the pile sleeve at a level between the first and second stage sleeves; and wherein securing the pile to the pile sleeve comprises injecting and setting grout in the annulus of the first stage sleeve between the pile and the pile sleeve.

10. A method for reusing an offshore platform jacket, comprising:

initially installing the offshore platform jacket, comprising:

setting the offshore platform jacket onto the seafloor at site;

securing piles into the seafloor through pile sleeves;

inserting a locking tool into the pile and securing hydraulic seals above and below a first locking profile presented on the interior of the pile sleeve, but isolated from a second locking profile on the interior of the pile sleeve;

extruding the walls of the pile into the first locking profile with hydraulic pressure provided by the locking tool; and depressurizing and removing the locking tool; and retrieving the offshore platform jacket upon depletion of hydrocarbon reserves at the initial site, comprising:

retrieving topside facilities from the offshore platform jacket;

cutting the concentric pile and pile sleeve and removing the extension of the pile sleeve containing the first locking profile; and raising the offshore platform jacket and rigging for transport; and redeploying the offshore platform jacket, comprising:

setting the offshore platform jacket onto the seafloor at a second site;

securing piles into the seafloor through pile sleeves;

inserting a locking tool into the pile and securing hydraulic seals above and below the second locking profile presented on the interior of the pile sleeve;

extruding the walls of the pile into the second locking profile with hydraulic pressure provided by the locking tool; and depressurizing and removing the locking tool.

11. A method for connecting a pile to a pile sleeve in the foundation of an offshore platform jacket, comprising:

setting the pile into an ocean floor through the pile sleeve;

isolating a first stage of a pile-to-pile sleeve interconnection from a second stage; comprising:

inserting a locking tool into the pile;

securing hydraulic seals in the pile above and below the level of a first locking profile in the first stage of the pile sleeve, but at a level not aligned with a second stage locking profile; and securing the pile to the pile sleeve at the first stage comprising extruding the walls of the pile into the first locking profile with hydraulic pressure provided by the locking tool.

* * * * *